US005616898A

United States Patent [19]

Maineult

[11] Patent Number: 5,616,898

[45] Date of Patent: Apr. 1, 1997

[54] MEDIUM-VOLTAGE OR HIGH-VOLTAGE CIRCUIT-BREAKER

[75] Inventor: Jean Maineult, Revonnas, France

[73] Assignee: GEC Alsthom T & D SA, Paris, France

[21] Appl. No.: 420,688

[22] Filed: Apr. 12, 1995

[30] Foreign Application Priority Data

Apr. 22, 1994 [FR] France ..... 94 04890

[51] Int. Cl.[6] ..... H01H 33/08; H01H 33/20

[52] U.S. Cl. ..... 218/76; 218/38; 218/156

[58] Field of Search ..... 218/1, 15, 22, 218/29, 34–40, 46, 47, 76, 81, 103, 104–106, 148–151, 156–158

[56] References Cited

U.S. PATENT DOCUMENTS

| | | | |
|---|---|---|---|
| 2,668,890 | 2/1954 | Latour | 200/144 |
| 3,626,127 | 12/1971 | Baldini | 200/147 R |
| 3,716,685 | 2/1973 | Wilson | 200/147 R |
| 4,295,021 | 10/1981 | Asinovsky et al. | 200/147 R |

FOREIGN PATENT DOCUMENTS

| | | | |
|---|---|---|---|
| 0378161A1 | 7/1990 | European Pat. Off. | H01H 33/10 |
| 1100959 | 9/1955 | France | H01H 33/18 |
| 6902765 | 12/1970 | France | H01H 33/00 |

OTHER PUBLICATIONS

French Search Report FR 9404890, Nov. 30, 1994.

*Primary Examiner*—Michael L. Gellner
*Assistant Examiner*—Michael A. Friedhofer
*Attorney, Agent, or Firm*—Sughrue, Mion, Zinn, Macpeak & Seas

[57] ABSTRACT

A medium-voltage or high-voltage circuit-breaker including, in a casing filled with a dielectric gas, an interrupting chamber in which metal plates are disposed for splitting up an electric arc into a multitude of smaller or "elementary" arcs under the action of a magnetic field, the circuit-breaker including a helical insulating ramp winding around a central generator line, the ramp being disposed on the inside peripheral portion of the chamber and around a conductive electrode, and the metal plates being disposed along the ramp, around and at a distance from the conductive electrode.

12 Claims, 7 Drawing Sheets

MEDIUM-VOLTAGE OR HIGH-VOLTAGE CIRCUIT-BREAKER

The invention relates to a medium-voltage or high-voltage circuit-breaker including, in a casing filled with a dielectric gas, an interrupting chamber in which metal plates are disposed for splitting up an electric arc into a multitude of smaller or "elementary" arcs under the action of a magnetic field.

BACKGROUND OF THE INVENTION

Such a circuit-breaker is disclosed in Document FR-89 00 215. In that known circuit-breaker, the metal arc-splitting plates are stacked in a plurality of mutually juxtaposed compartments. The electric arc is divided by electrodes at the input of each compartment, and is then split up on the metal plates inside each compartment under the action of magnetic fields.

Disposing the metal arc-splitting plates in this way increases the overall size of the interrupting chamber, whereas it is desirable to reduce the overall size thereof.

Moreover, in that known circuit-breaker, it is necessary to create separate magnetic fields for the various compartments, one field being required per compartment. Each magnetic field is created by conductors appropriately disposed at the input of a compartment. The conductors are folded bars. It has been observed that the force of the magnetic field created by that type of conductor remains insufficient to extinguish the electric arc effectively despite the fact that the arc is split up on the metal arc-splitting plates.

In that document, it is suggested that the folded-bar conductors could be replaced by electric coils. But, in practice, it is very difficult to insert such electric coils inside an interrupting chamber having the above-described disposition because of the distribution of the metal plates inside the compartments.

OBJECTS AND SUMMARY OF THE INVENTION

An object of the invention is to provide a medium-voltage or high-voltage circuit-breaker that uses the principle of splitting up the arc into a large number of elementary arcs by means of metal arc-splitting plates, but that has better interrupting effectiveness than the above-mentioned document, and that is easier to implement, while being of more compact design.

To this end, the invention provides a medium-voltage or high-voltage circuit-breaker, including a helical insulating ramp winding around a central generator line, the ramp being disposed on the inside peripheral portion of the chamber and around a conductive electrode, and the metal plates being disposed along said ramp, around and at a distance from the conductive electrode.

The section of the helical ramp in a plane that is perpendicular to its generator line may be of arbitrary shape provided that the distance between the arc-splitting plates and the electrode does not vary too much.

In commonly-used designs, it may be in the shape of a circle so that the overall shape of the interrupting chamber would be that of a cylinder. Said section may also be in the shape of a regular polygon, e.g. a hexagon, or an irregular polygon if it is advantageous to give preference to one particular design dimension of the interrupting chamber.

The magnetic field is directed in a direction that is substantially parallel to the central generator line of the ramp. It is easy to create such a magnetic field by means of at least one electric coil disposed at one end of the ramp.

It is preferable for the coil to be fed with at least a portion of the AC current input into the circuit-breaker. In this way, the magnetic field created by the coil is always in phase with the direction of the current flowing through the electric arc.

Such a coil configuration enables a magnetic field to be obtained that is strong enough to extinguish the electric arc effectively. The force of the magnetic field may be increased further if a second coil is provided disposed at the other end of the ramp.

Furthermore, the long length of the ramp enables the arc to be extended over a long distance, i.e. about 1.5 meters. As a result, the medium in the interrupting chamber is cooled effectively and is deionized quickly.

With such a configuration, the electric arc is displaced by being rotated very quickly about the conductive electrode under the action of the magnetic field. The arc takes up the shape of a solenoid as it penetrates into the ramp. The forces created by the magnetic field push the arc between the arc-splitting plates. The forces created by the magnetic field tend to stabilize the arc amongst the plates, thereby ensuring that the arcing voltage is high and stable in a compact space.

To prevent the electric arc from re-striking inside the interrupting chamber, the ramp comprises a plurality of turns between which the metal arc-splitting plates are inserted, the turns forming insulating screens between the metal plates.

Such a circuit-breaker may be used either for interrupting a current or for limiting a sudden increase in that current. In the latter case, the circuit-breaker may be referred to as a "current-limiting" circuit-breaker.

In the former case, a current circuit is provided for feeding the coil via means designed to split up an electric arc into a plurality of elementary arcs. In this way, the coil is fed with only a portion of current to be interrupted. The force of the magnetic field created by the coil depends on the magnitude of the portion of the current to be interrupted that is feeding the coil. The means for splitting up the arc serve to increase the voltage of the arc so as to increase the strength of the magnetic field accordingly.

In an embodiment that is simple to implement, the means for splitting up the arc include an insulating support disposed between a fixed arcing contact and an insertion contact for inserting the arc into the interrupting chamber, the insertion contact being connected electrically to the coil, and a series of conductive elements are provided carried by the insulating support and distributed over the insulating support between the fixed arcing contact and the insertion contact.

If the coil is placed between the insertion contact and the insulating ramp, electrically-insulating means are provided for steering the arc from the insertion contact to the metal arc-splitting plates.

In a simple embodiment, the insertion contact is carried by a conductive annular yoke on which the insulating means for steering the arc are disposed.

To improve upward progression of the electric arc from the insertion contact towards the ramp and therefore towards the arc-splitting plates, insulating means for steering the arc are provided that are helical in shape.

It is also advantageous, for reasons of compactness, to provide that the coil is installed on the periphery of the yoke.

When the circuit-breaker is to be used as a current limiter, the coil is fed with all of the current input into the circuit-breaker via the electrode which is movably mounted on a conductive element that co-operates electromagnetically with the coil, with the design of the ramp remaining identical.

In an embodiment that is simple to implement, the conductive element is a metal ring mounted on a pivot axis in the vicinity of the coil such that the ring moves towards the coil under the action of a resilient return element and it moves away from the coil under the effect of electromagnetic forces created by an increase in the current input into the circuit-breaker.

Such a configuration ensures that the circuit-breaker opens to a large enough extent in a very short time immediately after the short-circuit current appears. The opening system takes its energy from the short-circuit current. It is simple to implement and less costly than an opening system based on mechanical control means outside the circuit-breaker. The arc develops quickly in the interrupting chamber and it is split up on the metal arc-splitting plates quickly because the coil, which is fed with all of the current input into the circuit-breaker, continuously generates a strong magnetic field.

BRIEF DESCRIPTION OF THE DRAWINGS

Other characteristics and advantages of the invention will appear on reading the following description of embodiments of the invention given with reference to the accompanying drawings, in which.

MORE DETAILED DESCRIPTION

Figure 1:
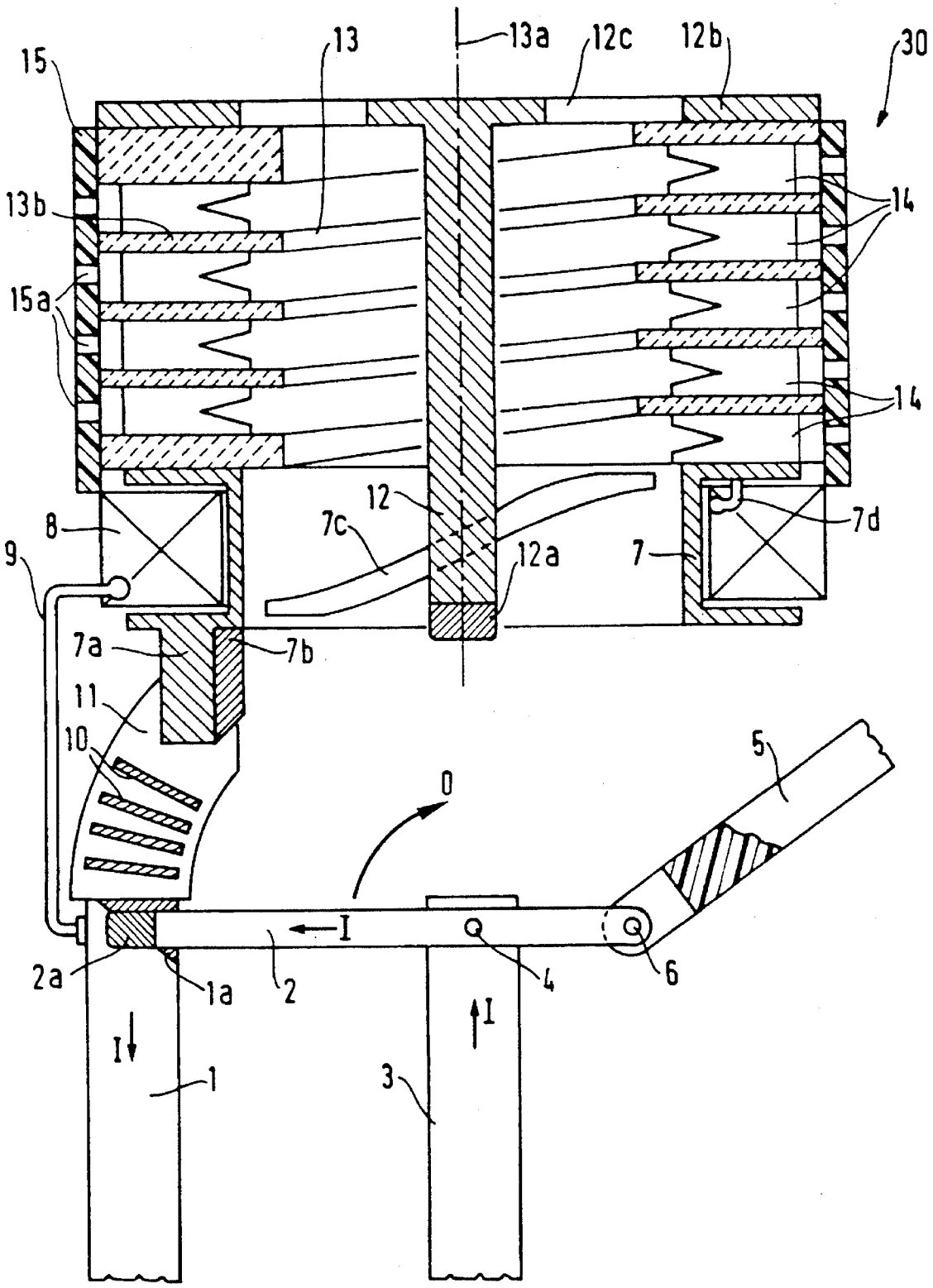
FIG. 1 is a diagrammatic section view of a first embodiment of the circuit-breaker, this non-current-limiting circuit-breaker being in the closed position.

FIG. 1 shows the inside of a medium-voltage or high-voltage circuit-breaker which serves to interrupt a current, the inside being shown in diagrammatic section. Such a circuit-breaker can be used for a single-phase current or for a poly-phase current.

The circuit-breaker includes a casing (not shown), which is filled with a dielectric gas such as sulfur hexafluoride ($SF_6$), under a pressure of a few bars.

Inside the casing, and for any one phase of the current, the circuit-breaker includes a fixed arcing contact represented diagrammatically by element 1. If necessary, this fixed arcing contact is protected by an element 1*a* having a high melting point so as to withstand an electric arc.

The contact 1 is connected to a terminal (not shown) feeding the current indicated by I inside the casing.

The circuit-breaker also includes a moving arcing contact represented diagrammatically by element 2. If necessary, this contact 2 is also protected by an element 2*a* having a high melting point so as to withstand an electric arc.

Arcing contact 2 is mounted to move about a pin 4 on a terminal 3 feeding the current inside the casing.

The moving contact 2 is displaced about the pin 4 via a connection rod 5 made of an insulating material and that is mounted to rotate about a pin 6 connected to one end of contact 2. The connection rod 5 is itself connected mechanically to a conventional drive device (not shown).

When the circuit-breaker is in the closed position, contact 2 is connected electrically to contact 1. When the circuit-breaker is in the open position, contact 1 and contact 2 are separated, and an electric arc then strikes between the two contacts when the current input terminals are fed with a current to be interrupted.

In general, the fixed contact 1 and the moving contact 2 are in the form of series of knives or blades such as those shown and described in Document FR-89 00 215.

The circuit-breaker further includes an interrupting chamber indicated by 30 and disposed in the vicinity of the contacts 1 & 2.

The interrupting chamber includes a conductive electrode 7, e.g. in the form of an annular yoke. The yoke 7 is provided with an insertion contact 7*a* or arcing horn which is designed to co-operate electrically with the moving arcing contact 2. Where applicable, contact 7*a* is protected by an element 7*b* having a high melting point so as to withstand an electric arc.

The electrode 7 in the form of an annular yoke includes an insulating element 7*c* implemented by a recess in the wall of the yoke, which recess is preferably helical in shape. The recess is filled with dielectric gas, thereby making it insulating. In a variant, the recess 7*c* is replaced by a deposit of an insulating substance on the inside wall of the yoke, which substance exhibits good resistance to high temperatures, e.g. such as a ceramic.

The outside periphery of the yoke 7 is surrounded by the windings of an electrical coil 8 which serves to create a magnetic field.

The coil 8 is connected electrically to the yoke 7 via a connector 7*d* and to the fixed arcing contact via a connector 9.

Contact 1 is separated from contact 7*a* by an insulating part 11 carrying metal strips 10 spaced apart and electrically insulated from one another. These strips 10 serve to split up the electric arc which is produced between the contacts 1 and 7*a* into a large number of electric elementary arcs so as to increase the powering voltage of the coil 8.

The interrupting chamber further includes a conductive electrode 12 that has its end 12*a* protected, if necessary, by an element having a high melting point so as to withstand an electric arc. This electrode is designed to co-operate electrically with the moving arcing contact 2.

Electrode 12 is terminated at its other end by a support plate 12*b* in the form of a disk, the plate 12*b* preferably being part of the same piece as the electrode 12.

In the example shown in FIG. 1, the interrupting chamber is in the form of circular cylinder and the electrode 12 extends along the axis of the cylinder.

The interrupting chamber further includes a helical insulating ramp 13 which winds around a central generator line 13*a*, which in this example coincides with the axis of the cylinder.

The insulating ramp 13 is disposed on the outside periphery of the interrupting chamber, and therefore on the inside surface of revolution of the cylinder.

In the configuration shown in FIG. 1, the insulating ramp 13 is covered at its top by a plate 12*b*, the electrode itself penetrating inside the part 13 so that the ramp 13 is also wound around the electrode 12.

A large number of metal plates 14 are disposed along the ramp 13, preferably at regular intervals of in the range 1 millimeter to 1.5 millimeters, the plates serving to split up the electric arc. The plates 14 may be pre-assembled together into packets so as to facilitate installing them along the ramp 13. The metal plates are therefore disposed around the electrode 12 and at a distance therefrom.

Preferably, locations (not shown) are provided in the ramp 13 for receiving each plate 14 and for holding it stationary in the installed position.

Each of the metal arc-splitting plates 14 is disposed on edge between two turns of the ramp 13, and is angularly positioned so that it extends radially towards the electrode 12 without being in contact therewith. Each plate has a V-shaped cut-out in its end portion that is closer to the electrode 12 so as to increase the speed at which the electric arc rises up inside the ramp 13. The plates are made of a magnetic material and the thickness of each of them lies in the range 0.8 mm to 2 mm.

The ramp is made in an insulating material exhibiting high resistance to temperature and to electrical arcing, e.g. such as a ceramic or a thermoplastic or thermosettable material.

The turns of the ramp extend far enough towards the electrode 12 to define screens **13*b* which insulate the arc-splitting plates 14** inserted between the respective consecutive turns.

A cylindrical insulating sheath 15 surrounds the ramp 13.

Part **12*b* and the sheath 15 are provided with orifices 12*c* and 15*a*** forming passages for expelling the dielectric gas.

The circuit-breaker shown in FIG. 1 operates as follows.

By acting on the drive device, the moving contact 2 is displaced in the direction indicted by arrow 0 shown in FIG. 1 between the fixed contact 1 and contact **7*a*, contacts 1 and 2** being fed with the current to be interrupted.

Figure 2:
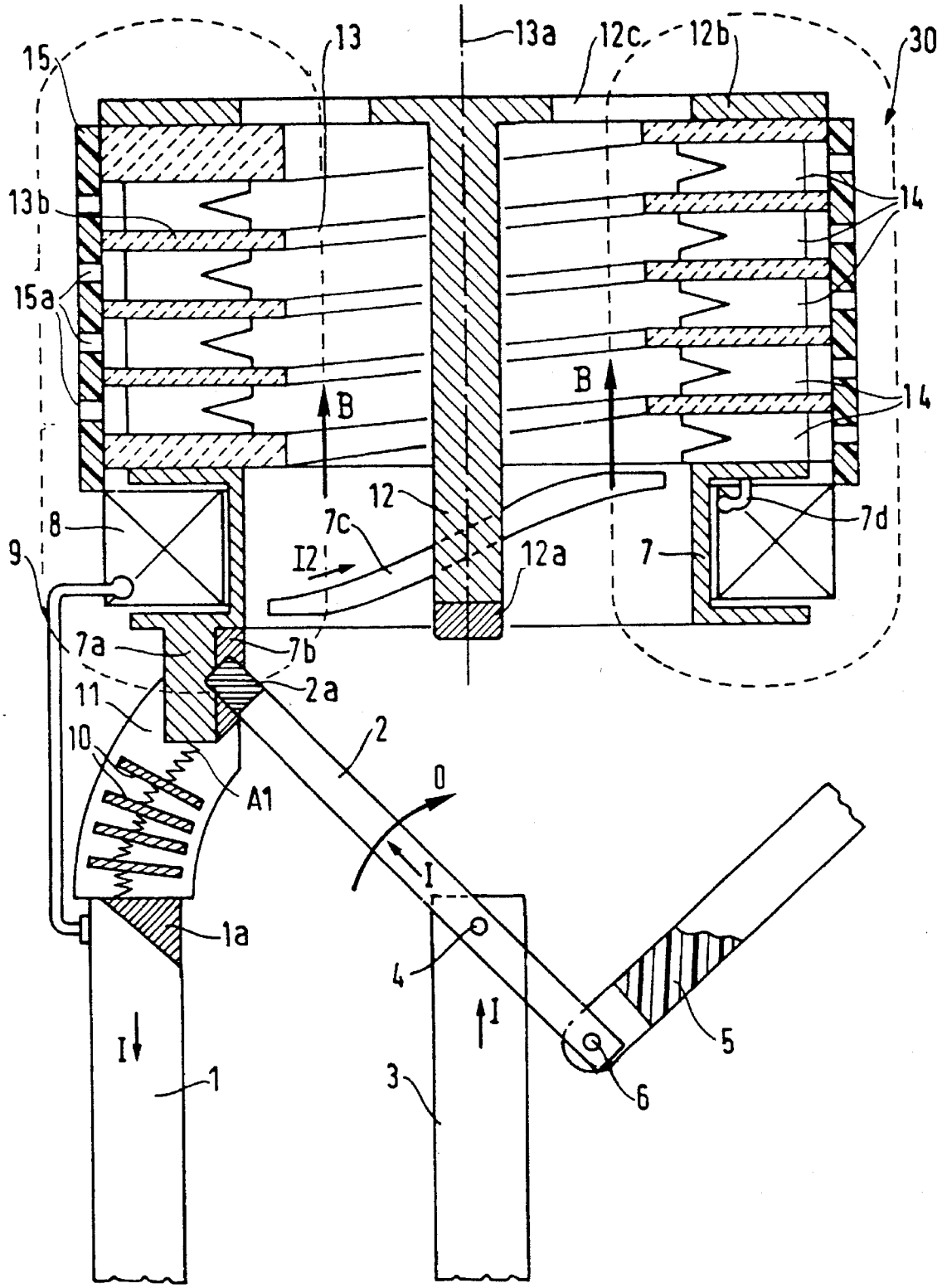
FIG. 2 shows the FIG. 1 circuit-breaker in a first semi-open position.

An electric arc A1 strikes between contact 1 and contacts 2 and **7*a* as shown in FIG. 2. Under the action of the electromagnetic forces created by contacts 1, 2, and 3, the electric arc A1 is split up on the metal strips 10** into a plurality of elementary arcs, thereby creating a large potential difference.

A portion I2 of the current to be interrupted I flows through the yoke 7, connector **7*d*, the coil 8, connector 9 and back to contact 1. The remaining portion I1 of the current I passes via the electric arc A1 striking between contacts 1 and 2 & 7*a***.

The current I2 flowing through the coil 8 creates a strong magnetic field (indicated by arrow B) in the interrupting chamber, which field is directed in a direction that is parallel to the generator line **13*a* of the ramp 13**.

Figure 3:
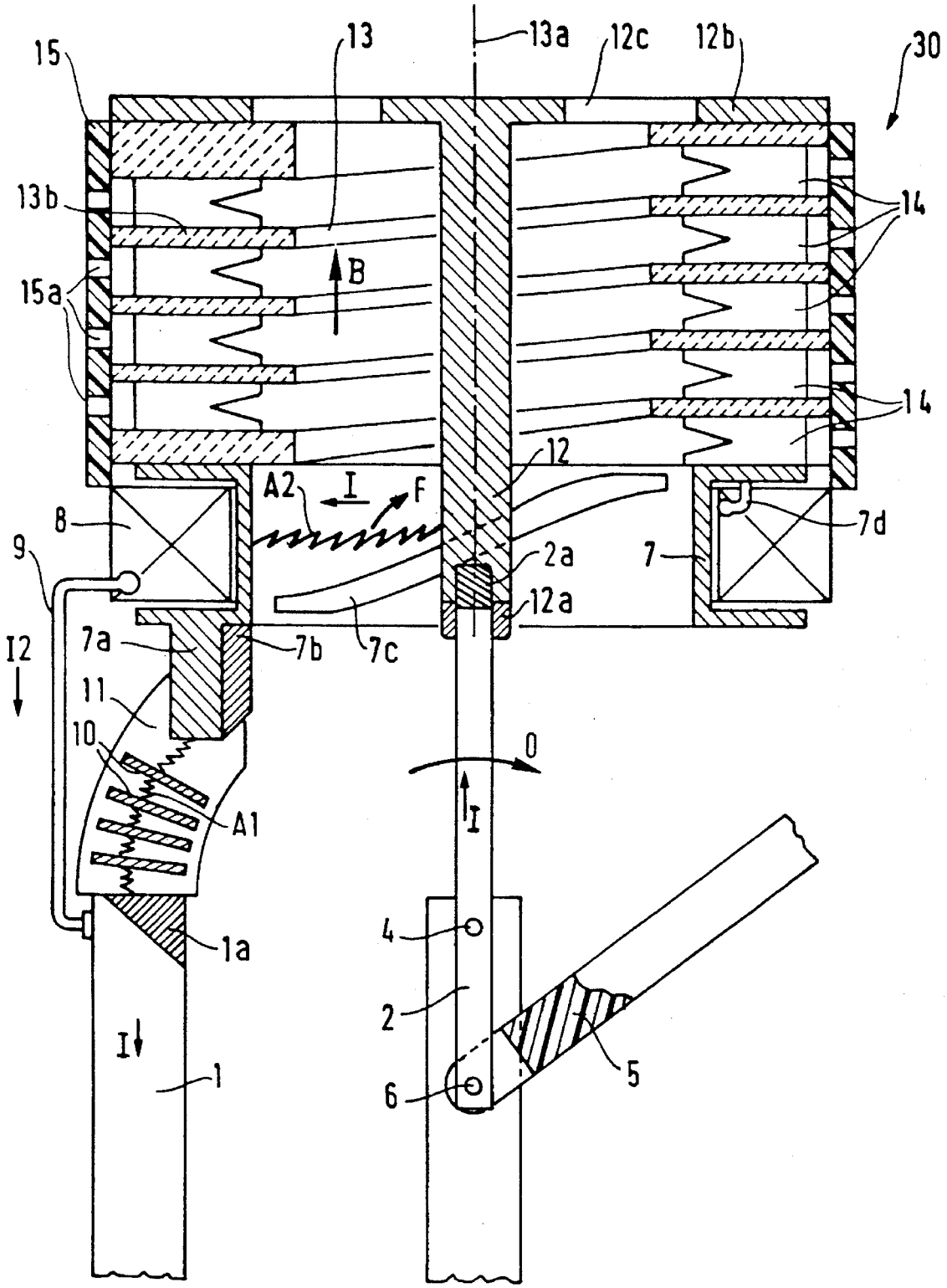
FIGS. 3 and 4 show the FIG. 1 circuit-breaker in a second semi-open position.

Contact 2 is then displaced from contact **7*a* towards electrode 12 as shown in FIG. 3. A second electric arc A2 through which all of the current I flows strikes between electrode 7 and electrode 12**.

Under the action of the electromagnetic forces (indicated by arrow F) created by contacts 1, 2, & 3, by the yoke 7, and by the electrode 12, and under the action of the magnetic field B, arc A2 is forced to penetrate inside electrode 7 and inside the ramp 13, while rotating and rising up about electrode 12.

The end of the second electric arc A2 on the yoke 7 is guided by the insulating element **7*c* and is directed towards the first arc-splitting plates 14. This arc then jumps from plate to plate along the helical ramp 13. The screens 13*b* act so as to prevent the second arc from re-striking between the turns of the ramp 13**.

Figure 4:
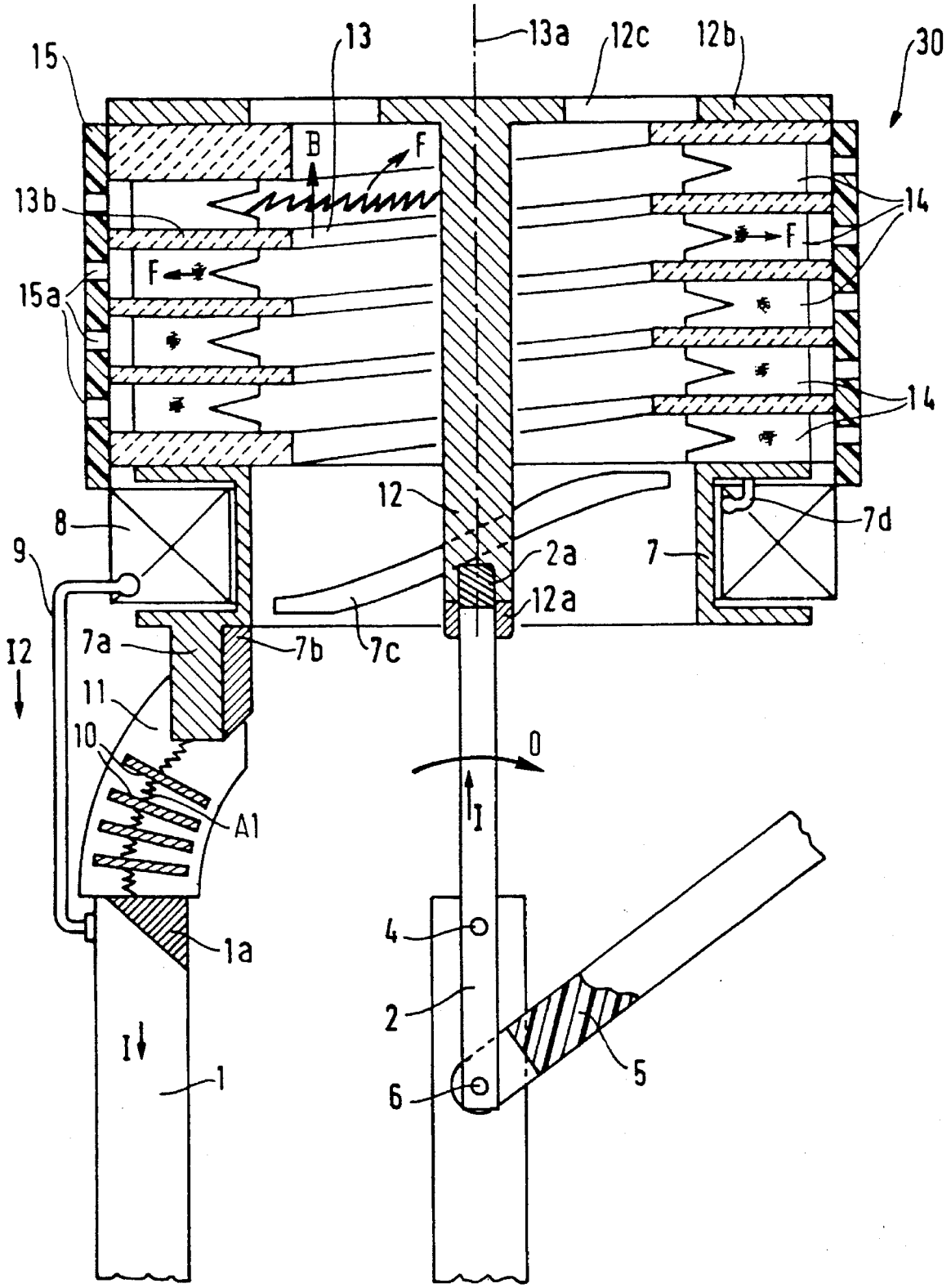

Under the action of the magnetic field B, the arcs penetrate between the plates 14 until they reach a position in which the field B cancels and they become stable in that position as shown in FIG. 4.

Because of the high arcing voltage created by splitting up arc A2 on the plates 14, the current I is reduced quickly.

Because the electric arc develops over a long length along the ramp 13, the dielectric gas is also deionized very effectively, and the circuit-breaker therefore has very high interrupting capabilities.

Continuing along its stroke, contact 2 separates from electrode 12. Even greater insulation is obtained between contacts 1 and 3, and the circuit-breaker reaches the fully-open position.

As indicated above, it is possible to implement a current-limiting circuit-breaker using the above-described principle. Such a circuit-breaker is shown in diagrammatic section in FIG. 5 inside its casing filled with a dielectric gas under pressure.

The above-described moving arcing contact is replaced in this example by a moving contact of the repulsion type.

For each phase, this circuit-breaker includes a first input terminal 101 for a current I, a second input terminal 112 for the current I, a moving contact of the repulsion type which co-operates with the two terminals, and an interrupting chamber indicated by 130.

Figure 5:
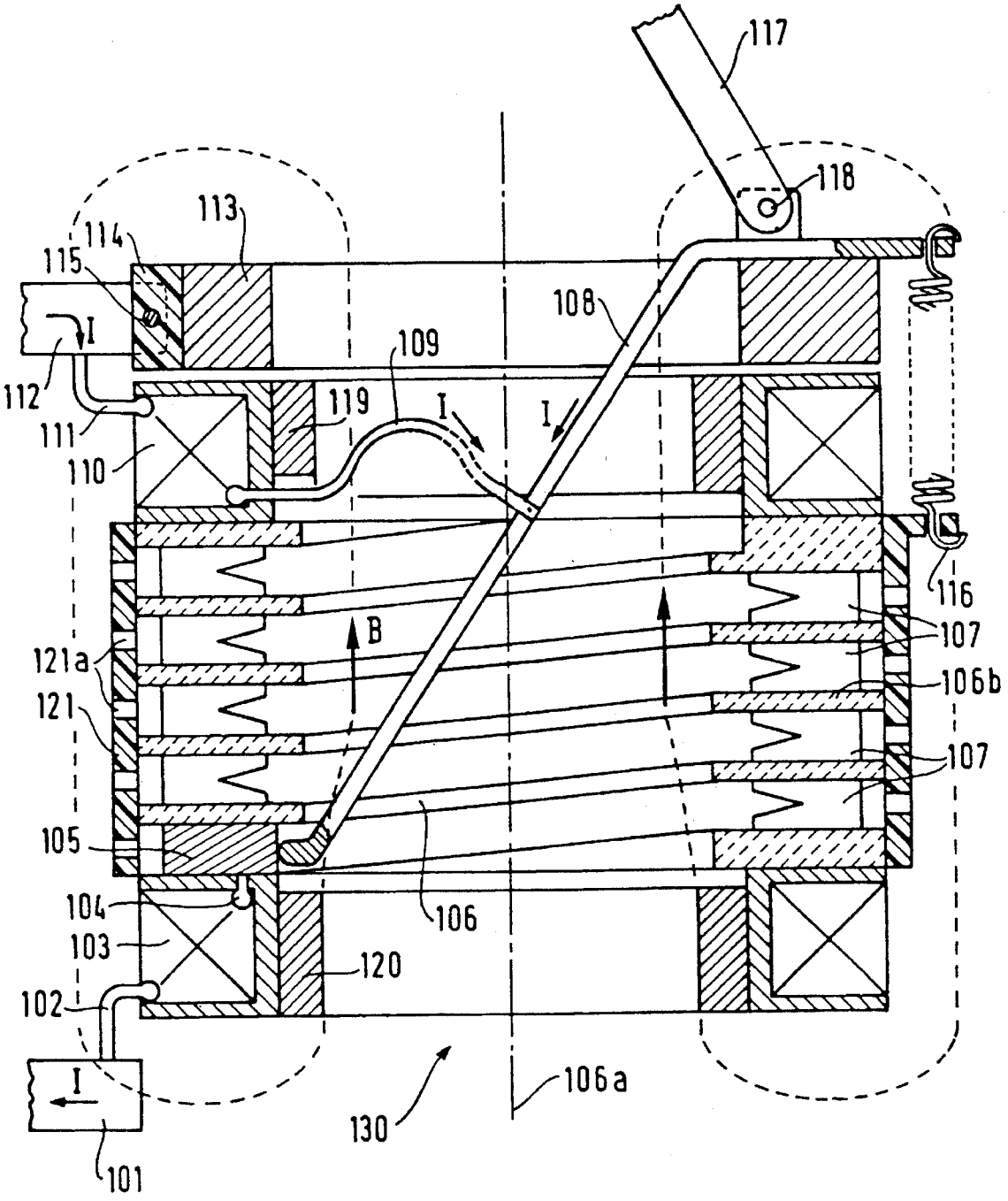
FIG. 5 is a diagrammatic section view of a second embodiment of the circuit-breaker, this current-limiting circuit-breaker being in the closed position.

The repulsion-type moving contact comprises a conductive part 113 hinged to terminal 112 via a pin 115, but electrically insulated from terminal 112 via an insulating part 114. It also includes a conductive electrode 108 carried by part 113. In FIG. 5, this part 113 is in the form of a ring disposed on the top of the interrupting chamber which is in the form of a cylinder, the electrode 108 extending inside the chamber.

The repulsion-type moving contact can be driven via an insulating connection rod 117 connected to a drive device (not shown). The insulating connection rod 117 is hinged to part 113 via a pin 118. In this case, the drive device is organized such that the connection rod is free to move under the effect of part 113 being displaced, as indicated above.

The interrupting chamber 130 includes, as shown in FIG. 1, a helical insulating ramp 106 winding inside the chamber around a central generator line **106*a*. Metal arc-splitting plates 107 are disposed along the insulating ramp 106 between the turns 106*b*** therein.

The input terminal 101 for the current I is connected to a first coil 103 via a conductive connector 102. The output of the coil 103 is connected electrically to an electrical contact tab 105 via a conductive connector 104.

The contact tab 105 and the coil 103 are disposed inside the chamber 130 and in the vicinity of one end of the ramp 106. The tab 105 is organized so as to co-operate with the free end of the electrode 108. The coil 103 serves to create a magnetic field (indicated by B) directed in a direction that is parallel to the generator line **106*a* of the ramp 106**.

A magnetic part such as 120 is provided inside the coil 103 so as to concentrate the magnetic field at the periphery of the interrupting chamber.

A second coil 110 is disposed at the other end of the ramp 106. This coil 106 is designed to co-operate electromagnetically with the conductive ring 113.

The electrode 108 is itself connected via a flexible electrical connector 109 to the coil 110, which is itself connected to terminal 112 via an electrical connector 111.

The coil 110 is organized so as to create a magnetic field in addition to the magnetic field B. A magnetic element 119 is also provided for modulating the strength of the magnetic field B inside the chamber 130.

As can be understood, the coils 110 and 103 are fed with all of the current I input into the circuit-breaker when electrode 108 is in contact with the tab 105 so that they create a magnetic field continuously, when the electrode 108 is in the position shown in FIG. 5.

The ring 113 is further connected to the chamber 130 via a spring 116 which prevents the ring from rotating about pin 115, and which tends to maintain the electrode 108 in contact with the tab 105.

Finally, an insulating sheath 121, e.g. made of a ceramic, and provided with orifices 121*a* through which gas can pass, surrounds the ramp 106 between the coils 110 and 103.

Such a current-limiting circuit-breaker operates as follows.

In FIG. 5, the current I input into the circuit-breaker flows through elements 101, 102, 103, 104, 105, 108, 109, 110, 111, and 112. Since the coils 103 and 110 are fed with all of the current I, they create a magnetic field B inside the interrupting chamber 130.

In the event of a sudden increase in the current, there is an immediate large increase in the magnetic field B created by the coils 103 & 110.

Figure 6:
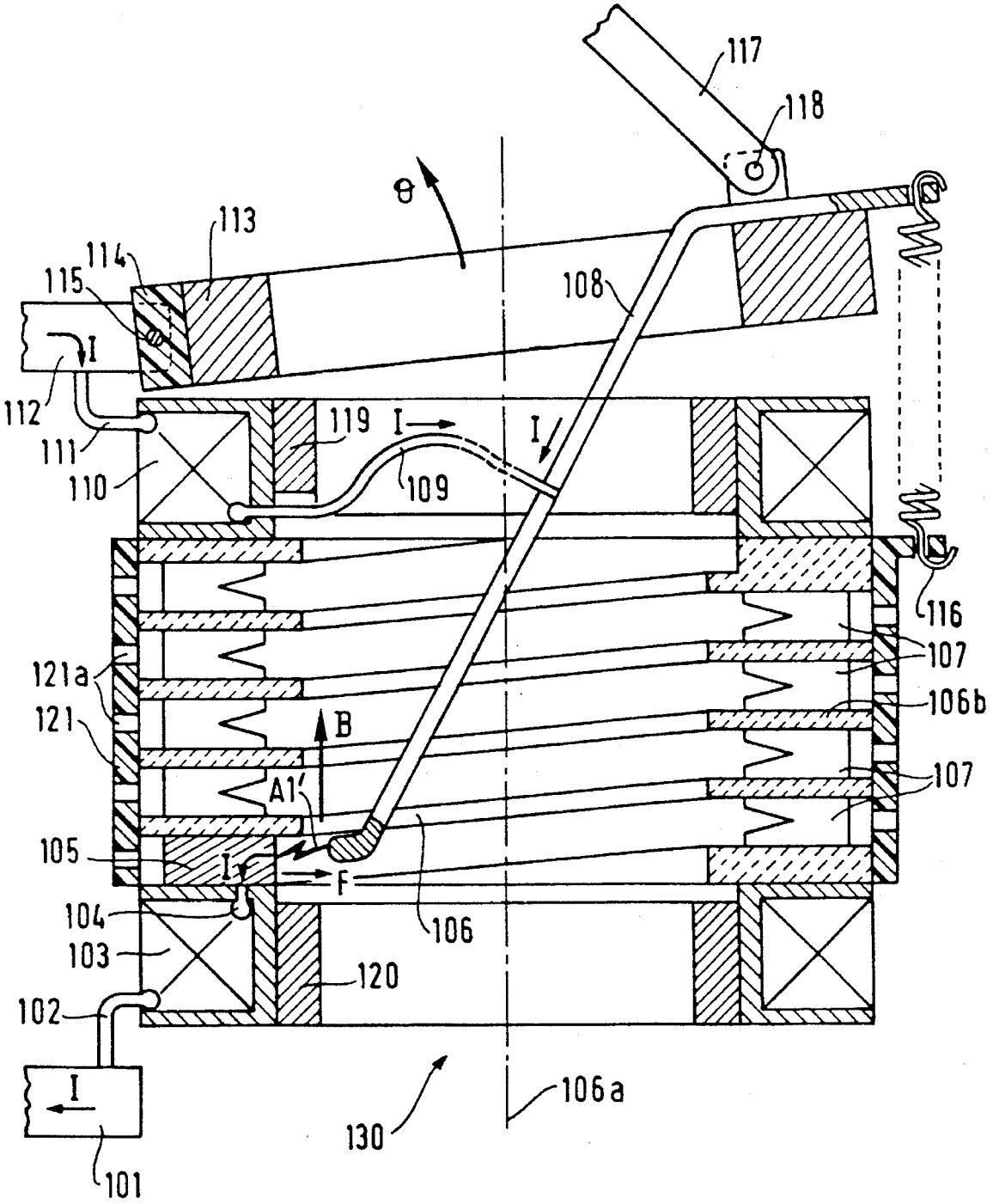
FIG. 6 shows the FIG. 5 circuit-breaker in a semi-open position.

This increase in the magnetic field B induces, in the conductive ring 113, currents flowing in the opposite direction from the current flowing through coil 110, thereby generating strong repulsion forces between those two elements. Under the action of the repulsion forces, the ring 113 moves away from the coil 110 by pivoting about the pin 115 as shown in FIG. 6.

Furthermore, an electric arc A1' strikes between the electrode 108 and the tab 105 at the same time as the ring 113 is being displaced relative to the interrupting chamber 130.

The magnetic field B induces, on the arc A1', an electromagnetic force represented by arrow F which tends to rotate the arc A1' about the electrode 108 and to cause it to rise up inside the ramp 106.

One end of the arc A1' follows the ramp 106 and latches onto the metal arc-splitting plates 107 in turn, the arc taking the shape of a solenoid as it develops.

Also under the action of the magnetic field B, the arc penetrates inside the plates 107 and becomes stabilized in the zone of the weak magnetic field, thereby creating a high and stable arcing voltage.

This arcing voltage causes the short-circuit current to be reduced to zero. The very long length of the arc enables the gaseous medium in the interrupting chamber to be deionized to a very large extent, and the voltage to be withstood after current zero.

Figure 7:
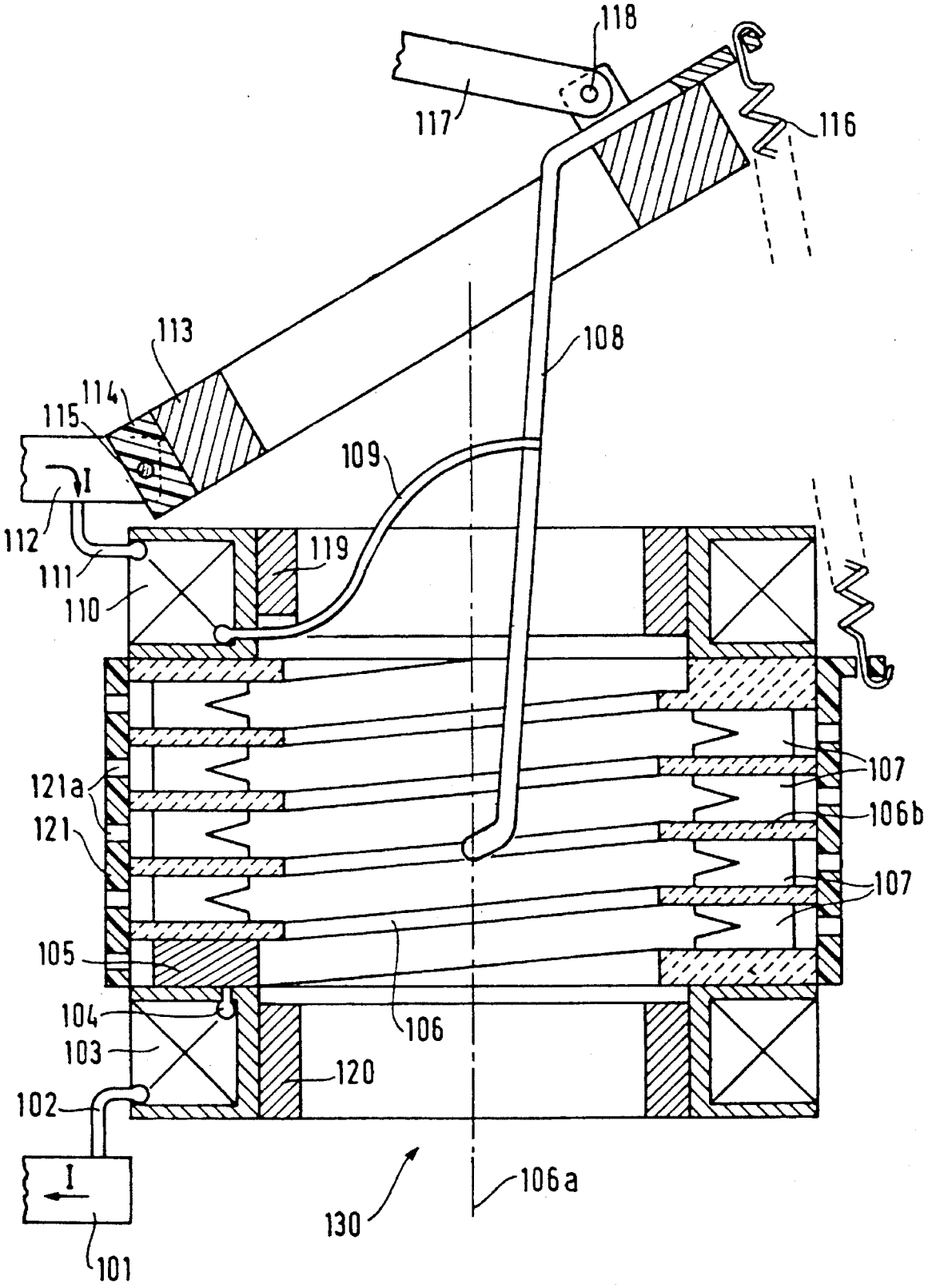
FIG. 7 shows the FIG. 5 circuit-breaker in an open position.

The ring 113 is displaced mechanically by the drive device which acts on the connection rod 117, and therefore on the electrode 108 so that the electrode 108 is placed in a position in which it is substantially coaxial with the generator line 106*a* of the ramp 106, as shown in FIG. 7. The electrode 108 becomes stabilized in this position, thereby enabling the voltage to be withstood fully between the input terminals 102 & 112.

I claim:

1. A medium voltage or high-voltage circuit-breaker including, in a casing filled with a dielectric gas, an interrupting chamber in which metal plates are disposed for splitting up an electric arc that is provided to the interrupting chamber into a multitude of smaller or elementary arcs under an action of a magnetic field, said circuit-breaker including a helical insulating ramp winding around a central generator line, the ramp being disposed on an inside peripheral portion of the chamber and around a conductive electrode, and the metal plates being disposed along said ramp, around and at a distance from the conductive electrode.

2. The circuit-breaker according to claim 1, including means for creating the magnetic field and for directing the magnetic field in a direction that is substantially parallel to the central generator line of the ramp.

3. The circuit-breaker according to claim 2, in which the magnetic field is created by at least one electrical coil disposed at one end of the ramp.

4. The circuit-breaker according to claim 3, including a current circuit feeding the coil via means designed to split up an electric arc that is provided to the current circuit into a respective plurality of elementary arcs.

5. The circuit-breaker according to claim 4, in which the means for splitting up the arc that is provided to the current circuit includes an insulating support disposed between a fixed arcing contact and an insertion contact for inserting the arc into the interrupting chamber, the insertion contact being connected electrically to the coil, and in which a series of conductive elements are carried by the insulating support and distributed over the insulating support between the fixed arcing contact and the insertion contact.

6. The circuit-breaker according to claim 5, including insulating means for steering the arc from the insertion contact to the metal arc-splitting plates.

7. The circuit-breaker according to claim 6, in which the insertion contact is carried by a conductive annular yoke on which the insulating means for steering the arc are disposed.

8. The circuit-breaker according to claim 7, in which the insulating means for steering the arc are helical in shape.

9. The circuit-breaker according to claim 7, in which the coil is installed on a periphery of the yoke.

10. The circuit-breaker according to claim 3, in which the coil is fed with all of a current input into the circuit-breaker via the electrode which is movably mounted on a conductive element that co-operates electromagnetically with the coil.

11. The circuit-breaker according to claim 10, in which the conductive element is a metal ring mounted on a pivot axis in a vicinity of the coil such that the ring moves towards the coil under an action of a resilient return element and the ring moves away from the coil under an effect of electromagnetic forces created by an increase in current input into the circuit-breaker.

12. The circuit-breaker according to claim 1, in which the ramp comprises a plurality of turns between which the metal arc-splitting plates are inserted, the turns forming insulating screens between the metal plates.

* * * * *